US009799343B2

(12) United States Patent
Liu et al.

(10) Patent No.: US 9,799,343 B2
(45) Date of Patent: Oct. 24, 2017

(54) METHOD AND APPARATUS FOR PROCESSING TEMPORAL ENVELOPE OF AUDIO SIGNAL, AND ENCODER

(71) Applicant: HUAWEI TECHNOLOGIES CO., LTD., Shenzhen, Guangdong (CN)

(72) Inventors: Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/372,130

(22) Filed: Dec. 7, 2016

(65) Prior Publication Data

US 2017/0098451 A1 Apr. 6, 2017

Related U.S. Application Data

(63) Continuation of application No. PCT/CN2015/071727, filed on Jan. 28, 2015.

(30) Foreign Application Priority Data

Jun. 12, 2014 (CN) ..... 2014 1 0260730

(51) Int. Cl.
*G10L 19/00* (2013.01)
*G10L 21/00* (2013.01)
(Continued)

(52) U.S. Cl.
CPC ..... *G10L 19/022* (2013.01); *G10L 19/032* (2013.01); *G10L 19/12* (2013.01);
(Continued)

(58) Field of Classification Search
CPC ... G10L 19/0204; G10L 19/02; G10L 19/022; G10L 19/032; G10L 19/06; G10L 19/08;
(Continued)

(56) References Cited

U.S. PATENT DOCUMENTS 5,394,473 A 2/1995 Davidson
5,754,534 A * 5/1998 Nahumi ..... H04M 3/568 370/261
(Continued)

FOREIGN PATENT DOCUMENTS

CN 1424712 A 6/2003
CN 102859588 A 1/2013
(Continued)

OTHER PUBLICATIONS

XP40374138,Vaalgamaa M:"audio coding with auditory time-frequency noise shaping and irrelevancy reducing vector qantization",AES 60 East 42nd Street, Room 2520 New York USA Sep. 1, 1999. total 8 pages.
(Continued)

*Primary Examiner* — Edgar Guerra-Erazo
(74) *Attorney, Agent, or Firm* — Huawei Technologies Co., Ltd.

(57) ABSTRACT

A method and an apparatus for processing a temporal envelope of an audio signal, and an encoder are disclosed. When multiple temporal envelopes are solved, continuity of signal energy can be well maintained, and in addition, complexity of calculating a temporal envelope is reduced. The method includes: obtaining a high-band signal of the current frame audio signal according to the received current frame audio signal; dividing the high-band signal of the current frame signal into M subframes according to a predetermined temporal envelope quantity M, where M is an integer, M is greater than or equal to 2; calculating a temporal envelope of each of the subframes; performing windowing on the first subframe of the M subframes and the last subframe of the M subframes by using an asymmetric window function; and performing windowing on a subframe
(Continued)

except the first subframe and the last subframe of the M subframes.

15 Claims, 7 Drawing Sheets

(51) Int. Cl.

| | |
|---|---|
| ***G10L 19/022*** | (2013.01) |
| ***G10L 19/135*** | (2013.01) |
| ***G10L 19/20*** | (2013.01) |
| ***G10L 25/45*** | (2013.01) |
| ***G10L 21/038*** | (2013.01) |
| ***G10L 19/032*** | (2013.01) |
| ***G10L 19/12*** | (2013.01) |

(52) U.S. Cl.
CPC ..... *G10L 19/135* (2013.01); *G10L 19/20* (2013.01); *G10L 21/038* (2013.01); *G10L 25/45* (2013.01)

(58) Field of Classification Search
CPC ..... G10L 19/12; G10L 19/125; G10L 19/04; G10L 25/90; G10L 19/03; G06F 17/147
USPC ..... 704/500–504
See application file for complete search history.

(56) References Cited

U.S. PATENT DOCUMENTS

| | | | | |
|---|---|---|---|---|
| 6,654,716 | B2 * | 11/2003 | Bruhn | G10L 21/038 704/200.1 |
| 8,457,975 | B2 * | 6/2013 | Neuendorf | G10L 19/022 375/240 |
| 8,560,330 | B2 * | 10/2013 | Gao | G10L 21/038 704/208 |
| 8,718,804 | B2 * | 5/2014 | Gao | G10L 19/005 381/94.3 |
| 9,047,875 | B2 * | 6/2015 | Gao | G10L 21/038 |
| 9,275,644 | B2 * | 3/2016 | Rajendran | G10L 19/00 |
| 2010/0217607 | A1 | 8/2010 | Neuendorf et al. | |
| 2010/0286805 | A1 * | 11/2010 | Gao | G10L 19/0017 700/94 |
| 2011/0099005 | A1 | 4/2011 | Zhang et al. | |
| 2011/0288872 | A1 | 11/2011 | Liu et al. | |
| 2012/0016667 | A1 | 1/2012 | Gao | |
| 2012/0016668 | A1 | 1/2012 | Gao | |
| 2012/0245947 | A1 | 9/2012 | Neuendorf et al. | |
| 2012/0265541 | A1 | 10/2012 | Geiger et al. | |
| 2013/0246074 | A1 | 9/2013 | Taleb | |
| 2014/0044192 | A1 | 2/2014 | Liu et al. | |
| 2014/0207445 | A1 * | 7/2014 | Gao | G10L 19/005 704/220 |

FOREIGN PATENT DOCUMENTS

| | | | |
|---|---|---|---|
| JP | H10222194 | A | 8/1998 |
| JP | 2001166800 | A | 6/2001 |
| WO | 2012110482 | A2 | 8/2012 |
| WO | 2013066238 | A3 | 8/2013 |

OTHER PUBLICATIONS

XP50925846,"3GPP TS 26.445. V.12.0.0. 3rd generation partnership project; technical specification group services and system aspects; codec for enhanced voice service(EVS);detailed algorithmic description(release 12)", Sep. 23, 2014. total 48 pages.

* cited by examiner

METHOD AND APPARATUS FOR PROCESSING TEMPORAL ENVELOPE OF AUDIO SIGNAL, AND ENCODER

CROSS-REFERENCE TO RELATED APPLICATIONS

This application is a continuation of International Application No. PCT/CN2015/071727, filed on Jan. 28, 2015, which claims priority to Chinese Patent Application No. 201410260730.5, filed on Jun. 12, 2014. The disclosures of the aforementioned applications are hereby incorporated by reference in their entireties.

TECHNICAL FIELD

Embodiments of the present invention relate to the field of communications technologies, and in particular, to a method and an apparatus for processing a temporal envelope of an audio signal, and an encoder.

BACKGROUND

With rapid development of speech and audio compression technologies, various speech and audio coding algorithms emerge successively. During processing of a speech and audio coding algorithm, a temporal envelope needs to be calculated. An existing process of calculating and quantizing a temporal envelope is as follows: dividing a preprocessed original high-band signal and a predicted high-band signal separately into M subframes according to a preset quantity M of temporal envelopes for calculation, where M is a positive integer, performing windowing on a subframe, and then calculating a ratio of energy or an amplitude of the preprocessed original high-band signal to that of the predicted high-band signal in each subframe. The preset quantity M of the temporal envelopes for calculation is determined according to a lookahead buffer length. A lookahead buffer means that in a current frame, for a need of calculating some parameters, some last samples of an input signal are buffered and are not used, but are used when the parameters are calculated in a next frame, where samples buffered in a previous frame are used for the current frame. These buffered samples are a lookahead buffer, and a quantity of the buffered samples is a lookahead buffer length.

A problem existing in the foregoing process of processing a temporal envelope is that when a temporal envelope is solved, a symmetric window function is used, and in addition, to ensure inter-subframe and inter-frame aliasing, multiple temporal envelopes are calculated according to the lookahead buffer length. However, during calculation of a temporal envelope, if time-domain resolution of a signal is excessively high, discontinuous intra-frame energy is caused, thereby causing an extremely poor auditory experience.

SUMMARY

Embodiments of the present invention provide a method and an apparatus for processing a temporal envelope of an audio signal, and an encoder, to resolve a problem of discontinuous intra-frame energy caused when a temporal envelope is calculated.

According to a first aspect, an embodiment of the present invention provides a method for processing a temporal envelope of an audio signal, including:

obtaining a high-band signal of the current frame signal according to the received current frame signal;

dividing the high-band signal of the current frame signal into M subframes according to a predetermined temporal envelope quantity M, where M is an integer, M is greater than or equal to 2; and calculating a temporal envelope of each of the subframes, where the calculating a temporal envelope of each of the subframes includes:

performing windowing on the first subframe of the M subframes and the last subframe of the M subframes by using an asymmetric window function; and performing windowing on a subframe except the first subframe and the last subframe of the M subframes.

According to the method for processing a temporal envelope of an audio signal provided in this embodiment of the present invention, a temporal envelope is solved by using different window lengths and/or window shapes under different conditions, so as to reduce impact of energy discontinuity caused due to an excessively large difference between temporal envelopes, thereby improving performance of an output signal.

In a first possible implementation manner of the first aspect, before the performing windowing on the first subframe of the M subframes and the last subframe of the M subframes by using an asymmetric window function, the method further includes:

determining the asymmetric window function according to a lookahead buffer length of the high-band signal of the current frame signal; or determining the asymmetric window function according to a lookahead buffer length of the high-band signal of the current frame signal and the temporal envelope quantity M.

With reference to the first aspect or the first possible implementation manner of the first aspect, in a second possible implementation manner of the first aspect, the performing windowing on a subframe except the first subframe and the last subframe of the M subframes includes:

performing windowing on the subframe except the first subframe and the last subframe of the M subframes by using a symmetric window function; or performing windowing on the subframe except the first subframe and the last subframe of the M subframes by using an asymmetric window function.

With reference to the first aspect, in a third possible implementation manner of the first aspect, a window length of the asymmetric window function is the same as a window length of a window function used in windowing performed on the subframe except the first subframe and the last subframe of the M subframes.

With reference to the method according to any one of the first possible implementation manner of the first aspect to the third possible implementation manner of the first aspect, in a fourth possible implementation manner of the first aspect, the determining the asymmetric window function according to a lookahead buffer length of the high-band signal of the current frame audio signal includes:

when the lookahead buffer length of the high-band signal of the current frame signal is less than a first threshold, determining the asymmetric window function according to a high-band signal of a previous frame signal of the current frame and the lookahead buffer length of the high-band signal of the current frame signal, where an aliased part of an asymmetric window function used for the last subframe of the high-band signal of the previous frame signal of the current frame and an asymmetric window function used for the first subframe of the high-band signal of the current frame signal is equal to the lookahead buffer length of the high-band signal of the current frame signal, and the first threshold is equal to a frame length of the high-band signal of the current frame divided by M.

With reference to the method according to any one of the first possible implementation manner of the first aspect to the third possible implementation manner of the first aspect, in a fifth possible implementation manner of the first aspect, the determining the asymmetric window function according to a lookahead buffer length of the high-band signal of the current frame signal includes:

when the lookahead buffer length of the high-band signal of the current frame signal is greater than a first threshold, determining the asymmetric window function according to a high-band signal of a previous frame signal of the current frame and the lookahead buffer length of the high-band signal of the current frame signal, where an aliased part of an asymmetric window function used for the last subframe of the high-band signal of the previous frame signal of the current frame and an asymmetric window function used for the first subframe of the high-band signal of the current frame signal is equal to the first threshold, and the first threshold is equal to a frame length of the high-band signal of the current frame divided by M.

With reference to the method according to any one of the first aspect to the fifth possible implementation manner of the first aspect, in a sixth possible implementation manner of the first aspect, the temporal envelope quantity M is determined in one of the following manners:

obtaining a low-band signal of the current frame signal according to the current frame signal, and when a pitch period of the low-band signal of the current frame signal is greater than a second threshold, assigning M1 to M; or obtaining a low-band signal of the current frame signal according to the current frame signal, and when a pitch period of the low-band signal of the current frame signal is not greater than a second threshold, assigning M2 to M, where both M1 and M2 are positive integers, and M2>M1.

With reference to the method according to any one of the first aspect to the fifth possible implementation manner of the first aspect, in a seventh possible implementation manner of the first aspect, the method further includes:

obtaining a pitch period of a low-band signal of the current frame signal according to the current frame signal; and when a type of the current frame signal is the same as a type of the previous frame signal of the current frame and the pitch period of the low-band signal of the current frame is greater than a third threshold, performing smoothing processing on the temporal envelope of each of the subframes.

According to a second aspect, an embodiment of the present invention provides an apparatus for processing a temporal envelope of an audio signal, including:

a high-band signal obtaining module, configured to obtain a high-band signal of the current frame signal according to the received current frame signal;

a subframe obtaining module, configured to divide the high-band signal of the current frame into M subframes according to a predetermined temporal envelope quantity M, where M is an integer, M is greater than or equal to 2; and a temporal envelope obtaining module, configured to calculate a temporal envelope of each of the subframes, where the temporal envelope obtaining module is configured to:

perform windowing on the first subframe of the M subframes and the last subframe of the M subframes by using an asymmetric window function; and perform windowing on a subframe except the first subframe and the last subframe of the M subframes.

According to the apparatus for processing a temporal envelope of an audio signal provided in this embodiment of the present invention, a temporal envelope is solved by using different window lengths and/or window shapes under different conditions, so as to reduce impact of energy discontinuity caused due to an excessively large difference between temporal envelopes, thereby improving performance of an output signal.

In a first possible implementation manner of the second aspect, the temporal envelope obtaining module is further configured to:

determine the asymmetric window function according to a lookahead buffer length of the high-band signal of the current frame signal; or determine the asymmetric window function according to a lookahead buffer length of the high-band signal of the current frame signal and the temporal envelope quantity M.

With reference to the implementation manner of the second aspect, in a second possible implementation manner of the second aspect, the temporal envelope obtaining module is configured to:

perform windowing on the first subframe of the M subframes and the last subframe of the M subframes by using the asymmetric window function, and perform windowing on the subframe except the first subframe and the last subframe of the M subframes by using a symmetric window function; or perform windowing on the first subframe of the M subframes and the last subframe of the M subframes by using the asymmetric window function, and perform windowing on the subframe except the first subframe and the last subframe of the M subframes by using an asymmetric window function.

With reference to the implementation manner of the second aspect, in a third possible implementation manner of the second aspect, a window length of the asymmetric window function is the same as a window length of a window function used in windowing performed on the subframe except the first subframe and the last subframe of the M subframes.

With reference to the apparatus according to any one of the second aspect to the third possible implementation manner of the second aspect, in a fourth possible implementation manner of the second aspect, the apparatus further includes: a determining module, configured to determine the temporal envelope quantity M in one of the following manners:

obtaining a low-band signal of the current frame signal according to the current frame signal, and when a pitch period of the low-band signal of the current frame signal is greater than a second threshold, assigning M1 to M; or obtaining a low-band signal of the current frame signal according to the current frame signal, and when a pitch period of the low-band signal of the current frame signal is not greater than a second threshold, assigning M2 to M, where both M1 and M2 are positive integers, and M2>M1.

An embodiment of a third aspect of the present invention discloses an encoder, where the encoder is configured to:

obtain a low-band signal of the current frame signal and a high-band signal of the current frame signal according to the received current frame signal;

encode the low-band signal of the current frame signal, to obtain a low-band encoded excitation signal;

perform linear prediction on the high-band signal of the current frame signal, to obtain a linear prediction coefficient;

quantize the linear prediction coefficient, to obtain a quantized linear prediction coefficient;

obtain a predicted high-band signal according to the low-band encoded excitation signal and the quantized linear prediction coefficient;

calculate and quantize a temporal envelope of the predicted high-band signal, where the calculating a temporal envelope of the predicted high-band signal includes:

dividing the predicted high-band signal into M subframes according to a predetermined temporal envelope quantity M, where M is an integer, M is greater than or equal to 2;

performing windowing on the first subframe of the M subframes and the last subframe of the M subframes by using an asymmetric window function; and performing windowing on a subframe except the first subframe and the last subframe of the M subframes; and encode the quantized temporal envelope.

According to the encoder provided in this embodiment of the present invention, a temporal envelope is solved by using different window lengths and/or window shapes under different conditions, so as to reduce impact of energy discontinuity caused due to an excessively large difference between temporal envelopes, thereby improving performance of an output signal.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show some embodiments of the present invention, and persons of ordinary skill in the art may still derive other drawings from these accompanying drawings without creative efforts.

DESCRIPTION OF EMBODIMENTS

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are a part rather than all of the embodiments of the present invention. All other embodiments obtained by persons of ordinary skill in the art based on the embodiments of the present invention without creative efforts shall fall within the protection scope of the present invention.

Figure 1:
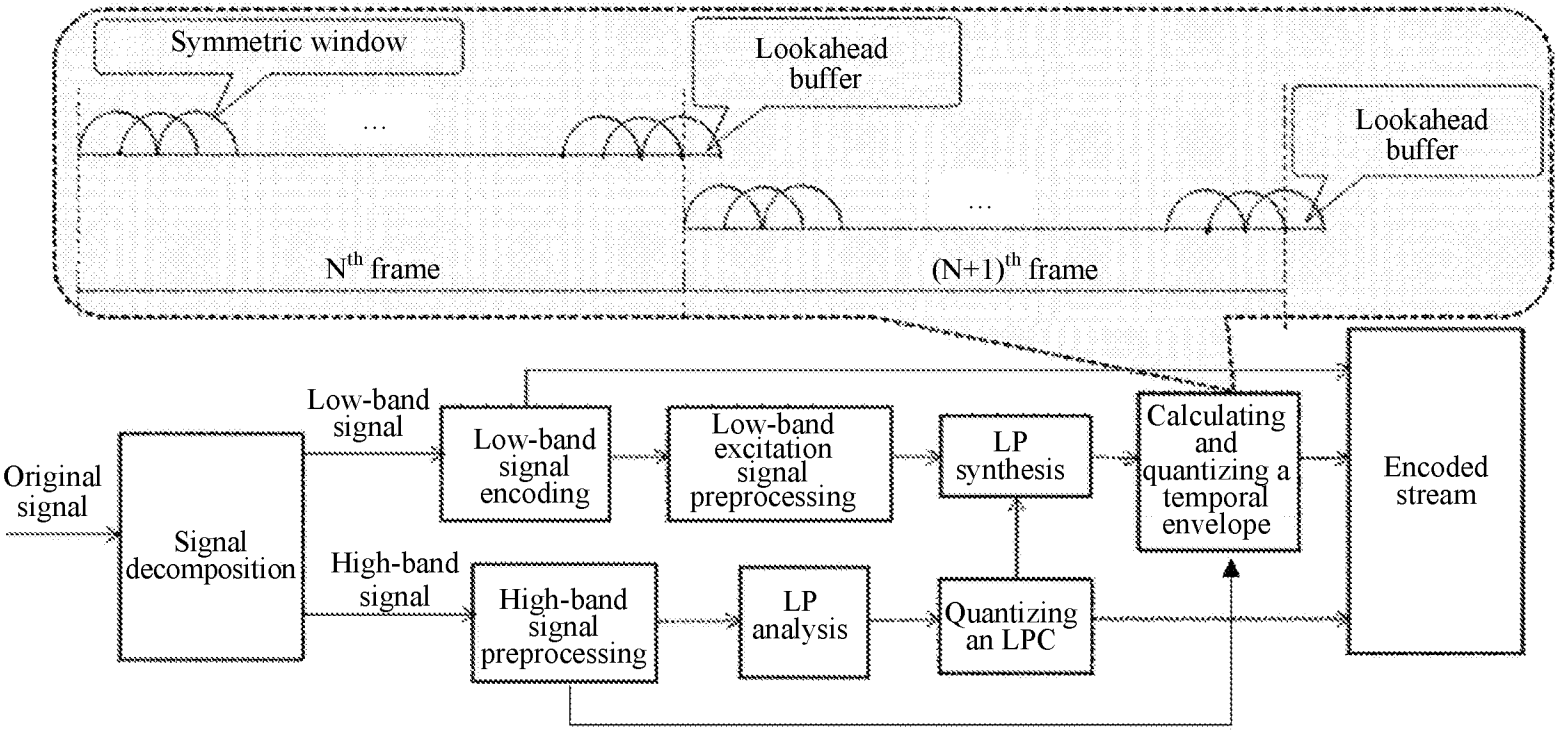
FIG. 1 is a schematic diagram of a process of encoding an audio signal.

FIG. 1 is a schematic diagram of a process of encoding a speech or audio signal. As shown in FIG. 1, on an encoding side, after an original audio signal is obtained, signal decomposition is first performed on the original audio signal, to obtain a low-band signal and a high-band signal of the original audio signal. Subsequently, the low-band signal is encoded by using an existing algorithm, to obtain a low-band stream. The existing algorithm is an algorithm such as an algebraic code excited linear prediction (ACELP), or a code excited linear prediction (CELP). In addition, in a process of performing low-band encoding, a low-band excitation signal is obtained, and the low-band excitation signal is preprocessed. For the high-band signal of the original audio signal, preprocessing is first performed, then linear prediction (LP) analysis is performed, to obtain an LP coefficient, and the LP coefficient is quantized. Subsequently, the preprocessed low-band excitation signal is processed by using an LP synthesis filter (a filter coefficient is the quantized LP coefficient), to obtain a predicted high-band signal. A temporal envelope of the high-band signal is calculated and quantized according to the preprocessed high-band signal and the predicted high-band signal, and finally, an encoded stream (MUX) is output. A process of calculating and quantizing the temporal envelope of the high-band signal is as follows: dividing the preprocessed high-band signal and the predicted high-band signal separately into N subframes according to a preset temporal envelope quantity N; performing windowing on each of the subframes; and then calculating an average value of time-domain energy of the subframes of the preprocessed original high-band signal, or an average value of sample amplitudes in the subframes of the preprocessed original high-band signal; and an average value of time-domain energy of the corresponding subframes of the predicted high-band signal, or an average value of sample amplitudes in the corresponding subframes of the predicted high-band signal. The preset temporal envelope quantity N is determined according to a lookahead buffer length, where N is a positive integer.

This embodiment of the present invention provides a method for processing a temporal envelope of an audio signal, which is mainly used for steps of calculating and quantizing a temporal envelope shown in FIG. 1, and may be further used for another processing process of solving a temporal envelope by using a same principle. The following describes the method for processing a temporal envelope of an audio signal provided in this embodiment of the present invention in detail with reference to the accompanying drawings.

Figure 2:
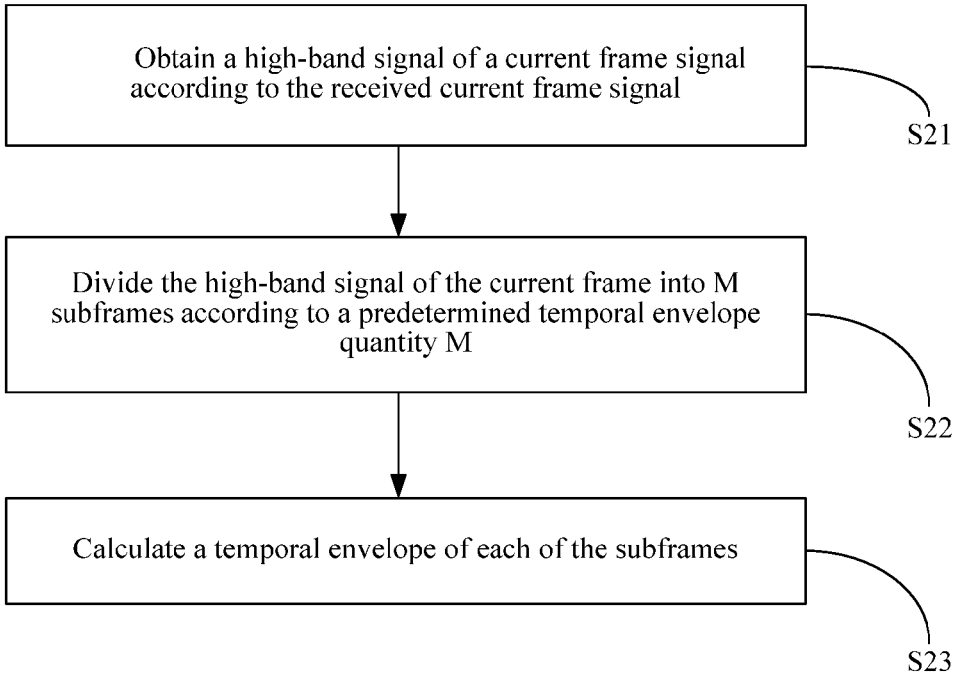
FIG. 2 is a flowchart of Embodiment 1 of a method for processing a temporal envelope of an audio signal according to the present invention.

FIG. 2 is a flowchart of Embodiment 1 of a method for processing a temporal envelope of an audio signal according to the present invention. As shown in FIG. 2, the method of this embodiment includes the following steps.

S21. Obtain a high-band signal of the current frame signal according to the received current frame signal.

The current frame signal may be a speech signal, may be a music signal, or may be a noise signal, which is not specifically limited herein.

S22. Divide the high-band signal of the current frame into M subframes according to a predetermined temporal envelope quantity M, where M is an integer, M is greater than or equal to 2.

The predetermined temporal envelope quantity M may be determined according to a requirement of an overall algorithm and an empirical value. The temporal envelope quantity M is, for example, predetermined by an encoder according to the overall algorithm or the empirical value, and does not change after being determined. For example, generally, for an input signal with a frame of 20 ms, if the input signal is relatively stable, four or two temporal envelopes are solved, but for some unstable signals, more temporal envelopes, for example, eight temporal envelopes, need to be solved.

S23. Calculate a temporal envelope of each of the subframes.

The calculating a temporal envelope of each of the subframes includes:

performing windowing on the first subframe of the M subframes and the last subframe of the M subframes by using an asymmetric window function; and performing windowing on a subframe except the first subframe and the last subframe of the M subframes.

Further, before the performing windowing on the first subframe of the M subframes and the last subframe of the M subframes by using an asymmetric window function, the method in this embodiment may further include:

determining the asymmetric window function according to a lookahead buffer length of the high-band signal of the current frame signal; or determining the asymmetric window function according to a lookahead buffer length of the high-band signal of the current frame signal and the temporal envelope quantity M.

The performing windowing on a subframe except the first subframe and the last subframe of the M subframes may include:

performing windowing on the subframe except the first subframe and the last subframe of the M subframes by using a symmetric window function; or performing windowing on the subframe except the first subframe and the last subframe of the M subframes by using an asymmetric window function.

In a possible implementation manner, a window length of the asymmetric window function used in windowing performed on the first subframe and the last subframe is the same as a window length of a window function used in windowing performed on the subframe except the first subframe and the last subframe of the M subframes.

In the foregoing embodiment, in an implementable manner, the determining the asymmetric window function according to a lookahead buffer length of the high-band signal of the current frame audio signal includes:

when the lookahead buffer length of the high-band signal of the current frame signal is less than a first threshold, determining the asymmetric window function according to a high-band signal of a previous frame signal of the current frame and the lookahead buffer length of the high-band signal of the current frame signal, where an aliased part of an asymmetric window function used for the last subframe of the high-band signal of the previous frame signal of the current frame and an asymmetric window function used for the first subframe of the high-band signal of the current frame signal is equal to the lookahead buffer length of the high-band signal of the current frame signal, and the first threshold is equal to a frame length of the high-band signal of the current frame divided by M.

In a possible implementation manner, the determining the asymmetric window function according to a lookahead buffer length of the high-band signal of the current frame signal includes:

when the lookahead buffer length of the high-band signal of the current frame signal is greater than a first threshold, determining the asymmetric window function according to a high-band signal of a previous frame signal of the current frame and the lookahead buffer length of the high-band signal of the current frame signal, where an aliased part of an asymmetric window function used for the last subframe of the high-band signal of the previous frame signal of the current frame and an asymmetric window function used for the first subframe of the high-band signal of the current frame signal is equal to the first threshold, and the first threshold is equal to the frame length of the high-band signal of the current frame divided by M.

In an embodiment of the present invention, the temporal envelope quantity M is determined in one of the following manners:

obtaining a low-band signal of the current frame signal according to the current frame signal, and when a pitch period of the low-band signal of the current frame signal is greater than a second threshold, assigning M1 to M; or obtaining a low-band signal of the current frame signal according to the current frame signal, and when a pitch period of the low-band signal of the current frame signal is not greater than a second threshold, assigning M2 to M, where both M1 and M2 are positive integers, and M2>M1; and in a possible manner, M1=4 and M2=8.

In the foregoing embodiment, further, the method of this embodiment may further include:

obtaining the pitch period of the low-band signal of the current frame according to the current frame signal; and when a type of the current frame signal is the same as a type of the previous frame signal of the current frame and the pitch period of the low-band signal of the current frame is greater than a third threshold, performing smoothing processing on the temporal envelope of each of the subframes.

The performing smoothing processing on the temporal envelope may be: weighting temporal envelopes of two adjacent subframes, and using the weighted temporal envelopes as temporal envelopes of the two subframes. For example, when signals of two continuous frames on a decoding side are voiced signals, or one frame is a voiced signal and the other frame is a normal signal, and the pitch period of the low-band signal is greater than a given threshold (greater than 70 samples, in which case, a sampling rate of the low-band signal is 12.8 kHz), smoothing processing is performed on a temporal envelope of a decoded high-band signal; otherwise, the temporal envelope remains unchanged. The smoothing processing may be as follows:

$$env[0] = 0.5 * (env[0] + env[1]);$$

$$env[1] = 0.5 * (env[0] + env[1]);$$

$$\ldots$$

$$env[N-1] = 0.5 * (env[N-1] + env[N]); \text{ and}$$

$$env[N] = 0.5 * (env[N-1] + env[N]); \text{ where}$$

$$env[\,] \text{ is a temporal envelope.}$$

It can be understood that the foregoing step sequence numbers are merely examples used to help understand this embodiment of the present invention, and are not specific limitations on this embodiment of the present invention. In an actual processing process, the foregoing sequence limitations do not need to be strictly followed. For example, windowing may be first performed on the subframe except the first subframe and the last subframe, and then windowing is performed on the first subframe and the last subframe.

Figure 3:
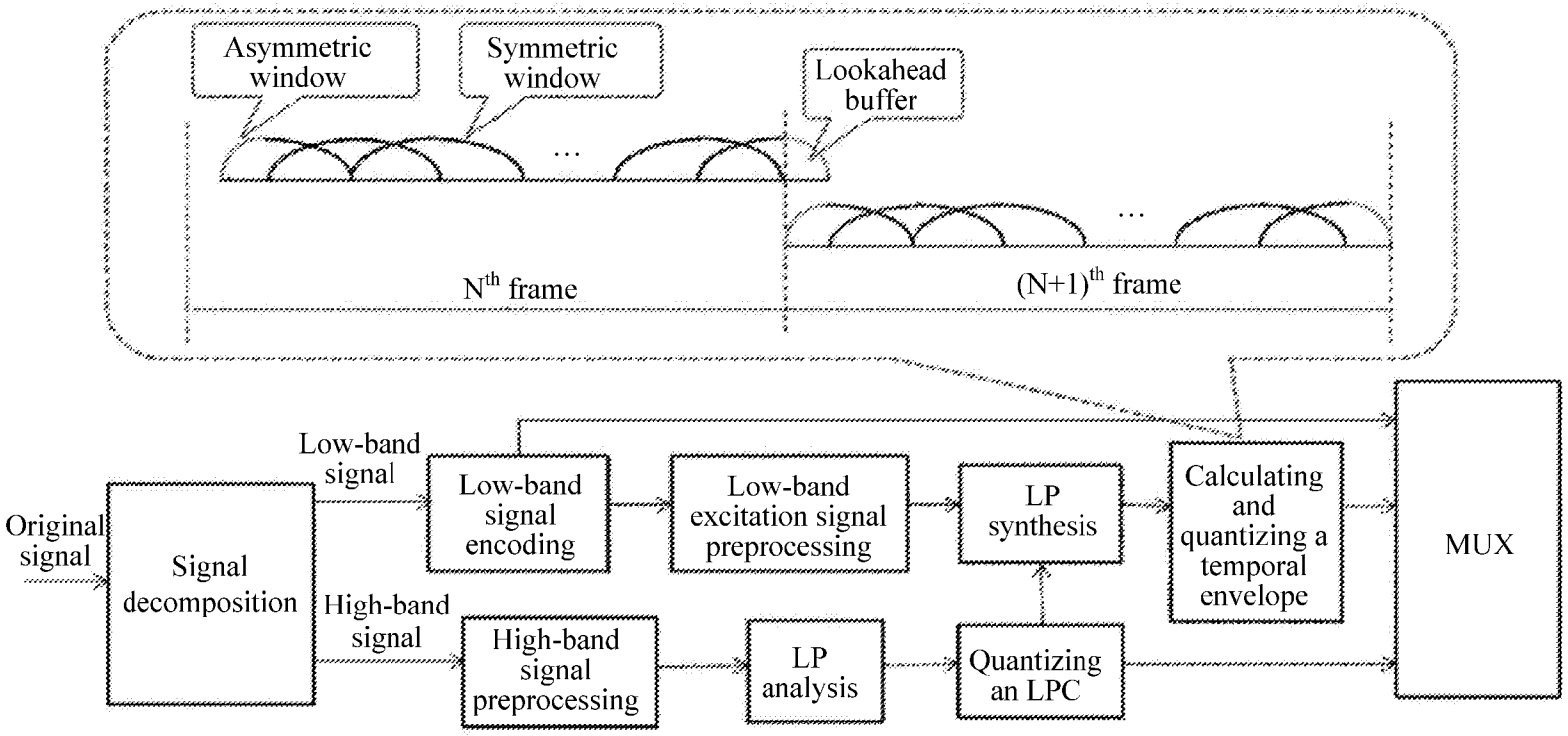
FIG. 3 is a schematic diagram showing processing on an audio signal according to an embodiment of the present invention.

FIG. 3 is a schematic diagram showing processing on an audio signal according to an embodiment of the present invention.

As shown in FIG. 3, on an encoding side, after an original audio signal is obtained, signal decomposition is first performed on the original audio signal, to obtain a low-band signal and a high-band signal of the original audio signal. Subsequently, the low-band signal is encoded by using an existing algorithm, to obtain a low-band stream. In addition, in a process of performing low-band encoding, a low-band excitation signal is obtained, and the low-band excitation signal is preprocessed. For the high-band signal of the original audio signal, preprocessing is first performed, then LP analysis is performed, to obtain an LP coefficient, and the LP coefficient is quantized. Subsequently, the preprocessed low-band excitation signal is processed by using an LP synthesis filter (a filter coefficient is the quantized LP coefficient), to obtain a predicted high-band signal. A temporal envelope of the high-band signal is calculated and quantized according to the preprocessed high-band signal and the predicted high-band signal, and finally, an encoded stream is output.

Except the step of calculating and quantizing the temporal envelope of the high-band signal, for processing of other steps of the audio signal, refer to a method used in the prior art, and details are not described herein.

The following describes in detail the step of calculating and quantizing the temporal envelope in this embodiment of the present invention by using processing on the $(N+1)^{th}$ frame shown in FIG. 3 as an example.

As shown in FIG. 3, the $(N+1)^{th}$ frame is divided into M subframes according to a quantity of temporal envelopes that need to be calculated, where M is a positive integer. In a possible implementation manner, a value of M may be 3, 4, 5, 8, or the like, which is not limited herein.

Windowing is performed on the first subframe of the M subframes and the last subframe of the M subframes by using an asymmetric window function. The first subframe of the M subframes of the $(N+1)^{th}$ frame is a subframe having an overlapped part with a signal of the previous frame (the $N^{th}$ frame); and the last subframe is a subframe having an overlapped part with a signal of a next frame (the $(N+2)^{th}$ frame, which is not shown in the figure). In a possible manner, as shown in FIG. 3, the first subframe is a leftmost subframe in the $(N+1)^{th}$ frame, and the last subframe is a rightmost subframe in the $(N+1)^{th}$ frame. It can be understood that leftmost and rightmost are merely specific examples with reference to FIG. 3, and are not limitations on this embodiment of the present invention. In practice, there is no directional limitation such as leftmost and rightmost in subframe division.

Asymmetric windows used to perform windowing on the first subframe and the last subframe may be completely the same or may be different, which is not limited herein. In a possible implementation manner, a window length of an asymmetric window function used for the first subframe is the same as a window length of an asymmetric window function used for the last subframe.

In an embodiment of the present invention, as shown in FIG. 3, windowing is performed on a subframe except the first subframe and the last subframe of the M subframes of the $(N+1)^{th}$ frame by using a symmetric window function.

In an embodiment of the present invention, a window length of the asymmetric window function used in windowing performed on the first subframe and the last subframe is equal to a window length of the symmetric window function used for another subframe. It can be understood that in another possible manner, the window length of the asymmetric window function may be not equal to the window length of the symmetric window function.

In an embodiment of the present invention, when a frame length of the $(N+1)^{th}$ frame is 80 samples and a sampling rate is 4 kHz, 8 temporal envelopes may be solved.

In a possible implementation manner, when the frame length of the $(N+1)^{th}$ frame is 80 samples and a sampling rate is 4 kHz, 4 temporal envelopes may be solved.

In an embodiment of the present invention, in addition to presetting, a quantity N of the temporal envelopes may be predetermined according to other information of the $(N+1)^{th}$ frame. The following is an example of an implementation manner of determining the quantity N of the temporal envelopes:

In a possible implementation manner, when a pitch period of a low-band signal of the $(N+1)^{th}$ frame is greater than a second threshold, 4 is assigned to N; or when a pitch period of a low-band signal of the $(N+1)^{th}$ frame is not greater than a second threshold, 8 is assigned to N. For a low-band signal whose sampling rate is 12.8 kHz, the second threshold may be 70 samples. It can be understood that the foregoing values are merely specific examples used to help understand this embodiment of the present invention, and are not specific limitations on this embodiment of the present invention. As shown in FIG. 3, when signal decomposition is performed on a signal of the $(N+1)^{th}$ frame, the low-band signal of the $(N+1)^{th}$ frame may be obtained. A manner used in signal decomposition and a manner of solving the pitch period of the low-band signal may be any manner in the prior art, which is not specifically limited herein.

It can be understood that in addition to using the pitch period of the low-band signal, another parameter such as signal energy may be used.

In an embodiment of the present invention, when the asymmetric window function is used to perform windowing on the first subframe and the last subframe, the asymmetric window function is determined according to a lookahead buffer length.

In a possible implementation manner, when the frame length of the $(N+1)^{th}$ frame is 80 samples, the sampling rate is 4 kHz, and 8 temporal envelopes are solved, both the window length of the asymmetric window function used in windowing and the window length of the symmetric window function used in windowing may be 20 samples. A first threshold is obtained by dividing the frame length by a quantity of envelopes. In this example, the first threshold is equal to 10. When the lookahead buffer length is less than 10 samples, an aliased part of a window function used for the eighth subframe (this means, the last subframe) and a window function used for the first subframe (this means, the first subframe) is equal to the lookahead buffer length. When the lookahead buffer length is greater than or equal to 10 samples, a length of a right side of the window function used for the eighth subframe and a length of a left side of the window function used for the first subframe may be equal to a window length (10 samples) of the other side (for example, the right side of the window function used for the first subframe or the left side of the window function used for the eighth subframe); or a length may be set according to experience (for example, keeping a same length as that used when the lookahead buffer is less than 10 samples).

In a possible implementation manner, when the frame length of the $(N+1)^{th}$ frame is 80 samples, the sampling rate is 4 kHz, and 4 temporal envelopes are solved, both the window length of the asymmetric window function used in windowing and the window length of the symmetric window function used in windowing may be 40 samples. The first threshold is obtained by dividing the frame length by a quantity of envelopes. In this example, the first threshold is equal to 20.

After windowing, an average value of time-domain energy of the subframes of the preprocessed original high-band signal, or an average value of sample amplitudes in the subframes of the preprocessed original high-band signal; and an average value of time-domain energy of the subframes of the predicted high-band signal, or an average value of sample amplitudes in the subframes of the predicted high-band signal are calculated. For a specific calculation manner, refer to a manner provided in the prior art. Manners of determining a window shape and a needed window quantity that are used in windowing in the method for processing a signal provided in this embodiment of the present invention are different from those in the prior art. For another calculation manner, refer to a manner provided in the prior art.

According to the method for processing a temporal envelope of an audio signal provided in this embodiment of the present invention, a temporal envelope is solved by using different window lengths and/or window shapes under different conditions, so as to reduce impact of energy discontinuity caused due to an excessively large difference between temporal envelopes, thereby improving performance of an output signal.

Figure 4:
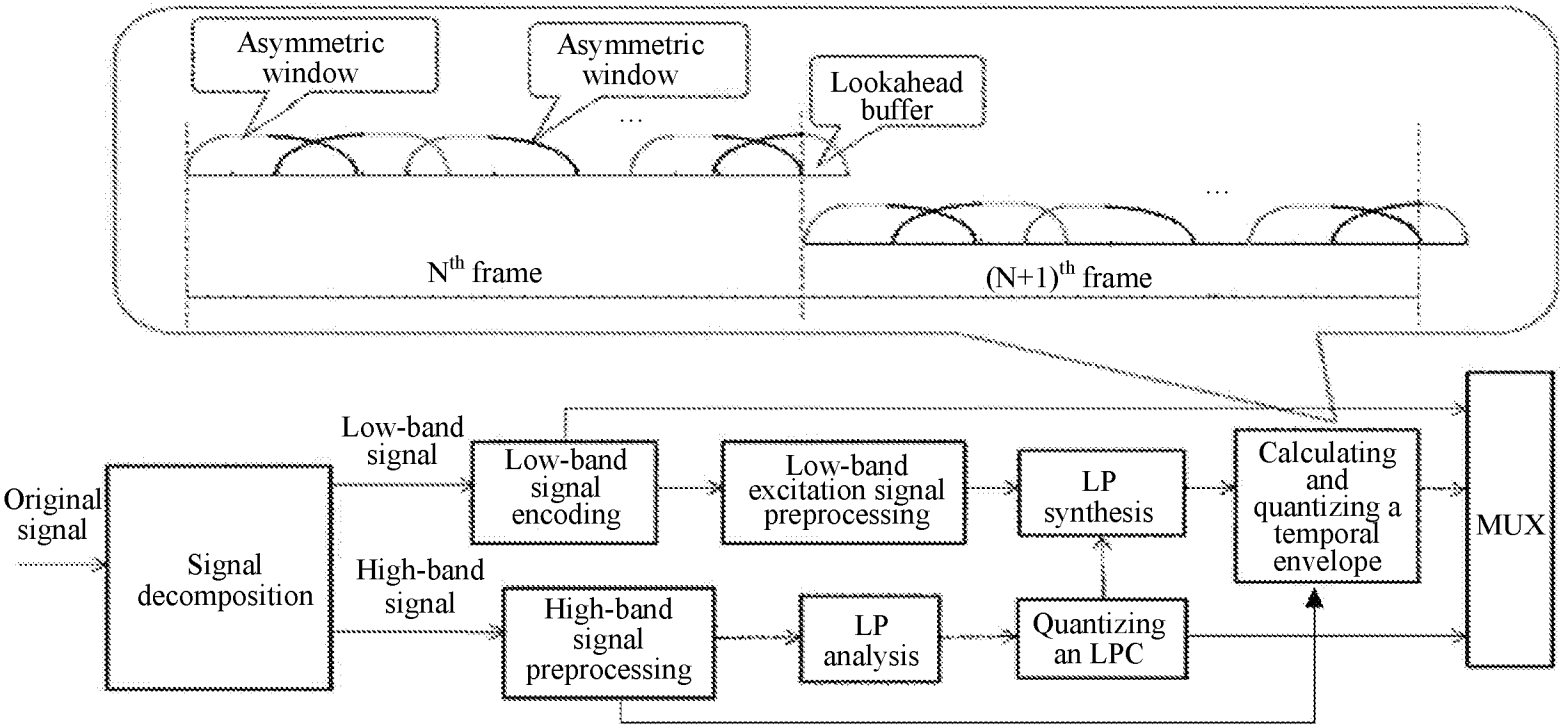
FIG. 4 is a schematic diagram showing processing on an audio signal according to another embodiment of the present invention.

The following describes in detail the step of calculating and quantizing the temporal envelope in another embodiment of the present invention by using processing on the $(N+1)^{th}$ frame shown in FIG. 4 as an example.

FIG. 4 is a schematic diagram showing processing on an audio signal according to another embodiment of the present invention. As shown in FIG. 4, similar to what is shown in FIG. 3, the $(N+1)^{th}$ frame is divided into M subframes according to a quantity of temporal envelopes that need to be calculated, where M is a positive integer. In a possible implementation manner, a value of M may be 3, 4, 5, 8, or the like, which is not limited herein.

Windowing is performed on the first subframe of the M subframes and the last subframe of the M subframes by using an asymmetric window function. As shown in FIG. 4, the asymmetric window function used in windowing performed on the first subframe is different from the asymmetric window function used in windowing performed on the last subframe. In a possible implementation manner, a window length of the asymmetric window function used for the first subframe may be the same as a window length of the asymmetric window function used for the last subframe, or a window length of the asymmetric window function used for the first subframe may be different from a window length of the asymmetric window function used for the last subframe.

In an embodiment of the present invention, as shown in FIG. 4, windowing is performed on a subframe except the first subframe and the last subframe of the M subframes of the $(N+1)^{th}$ frame by using asymmetric windows of a same shape.

In an embodiment of the present invention, when a frame length of the $(N+1)^{th}$ frame is 80 samples and a sampling rate is 4 kHz, 8 temporal envelopes may be solved.

In a possible implementation manner, when the frame length of the $(N+1)^{th}$ frame is 80 samples and a sampling rate is 4 kHz, 4 temporal envelopes may be solved.

In an embodiment of the present invention, in addition to presetting, a quantity N of the temporal envelopes may be predetermined according to other information of the $(N+1)^{th}$ frame. The following is an example of an implementation manner of determining the quantity N of the temporal envelopes:

In a possible implementation manner, when a pitch period of a low-band signal of the $(N+1)^{th}$ frame is greater than a second threshold, 4 is assigned to N; or when a pitch period of a low-band signal of the $(N+1)^{th}$ frame is not greater than a second threshold, 8 is assigned to N. For a low-band signal whose sampling rate is 12.8 kHz, the second threshold may be 70 samples. It can be understood that the foregoing values are merely specific examples used to help understand this embodiment of the present invention, and are not specific limitations on this embodiment of the present invention. As shown in FIG. 4, when signal decomposition is performed on a signal of the $(N+1)^{th}$ frame, the low-band signal of the $(N+1)^{th}$ frame may be obtained. A method used in signal decomposition and a manner of solving the pitch period of the low-band signal may be any manner in the prior art, which is not specifically limited herein.

It can be understood that in addition to using the pitch period of the low-band signal, another parameter such as signal energy may be used.

In an embodiment of the present invention, when the asymmetric window function is used to perform windowing on the first subframe and the last subframe, the asymmetric window function is determined according to a lookahead buffer length.

In a possible implementation manner, when the frame length of the $(N+1)^{th}$ frame is 80 samples, the sampling rate is 4 kHz, and 8 temporal envelopes are solved, both the window length of the asymmetric window function used in windowing and the window length of the symmetric window function used in windowing may be 20 samples. A first threshold is obtained by dividing the frame length by a quantity of envelopes. In this example, the first threshold is equal to 10. When the lookahead buffer length is less than 10 samples, an aliased part of a window function used for the eighth subframe (this means, the last subframe) and a window function used for the first subframe (this means, the first subframe) is equal to the lookahead buffer length. When the lookahead buffer length is greater than or equal to 10 samples, a length of a right side of the window function used for the eighth subframe and a length of a left side of the window function used for the first subframe may be equal to a window length (10 samples) of the other side (for example, the right side of the window function used for the first subframe or the left side of the window function used for the eighth subframe); or a length may be set according to experience (for example, keeping a same length as that used when the lookahead buffer is less than 10 samples).

In a possible implementation manner, when the frame length of the $(N+1)^{th}$ frame is 80 samples, the sampling rate is 4 kHz, and 4 temporal envelopes are solved, both the window length of the asymmetric window function used in windowing and the window length of the symmetric window function used in windowing may be 40 samples. The first threshold is obtained by dividing the frame length by a quantity of envelopes. In this example, the first threshold is equal to 20.

After windowing, an average value of time-domain energy of the subframes of the preprocessed original high-band signal, or an average value of sample amplitudes in the subframes of the preprocessed original high-band signal; and an average value of time-domain energy of the subframes of the predicted high-band signal, or an average value of sample amplitudes in the subframes of the predicted high-band signal are calculated. For a specific calculation manner, refer to a manner provided in the prior art. Manners of determining a window shape and a needed window quantity that are used in windowing in the method for processing a signal provided in this embodiment of the present invention are different from those in the prior art. For another calculation manner, refer to a manner provided in the prior art.

Figure 5:
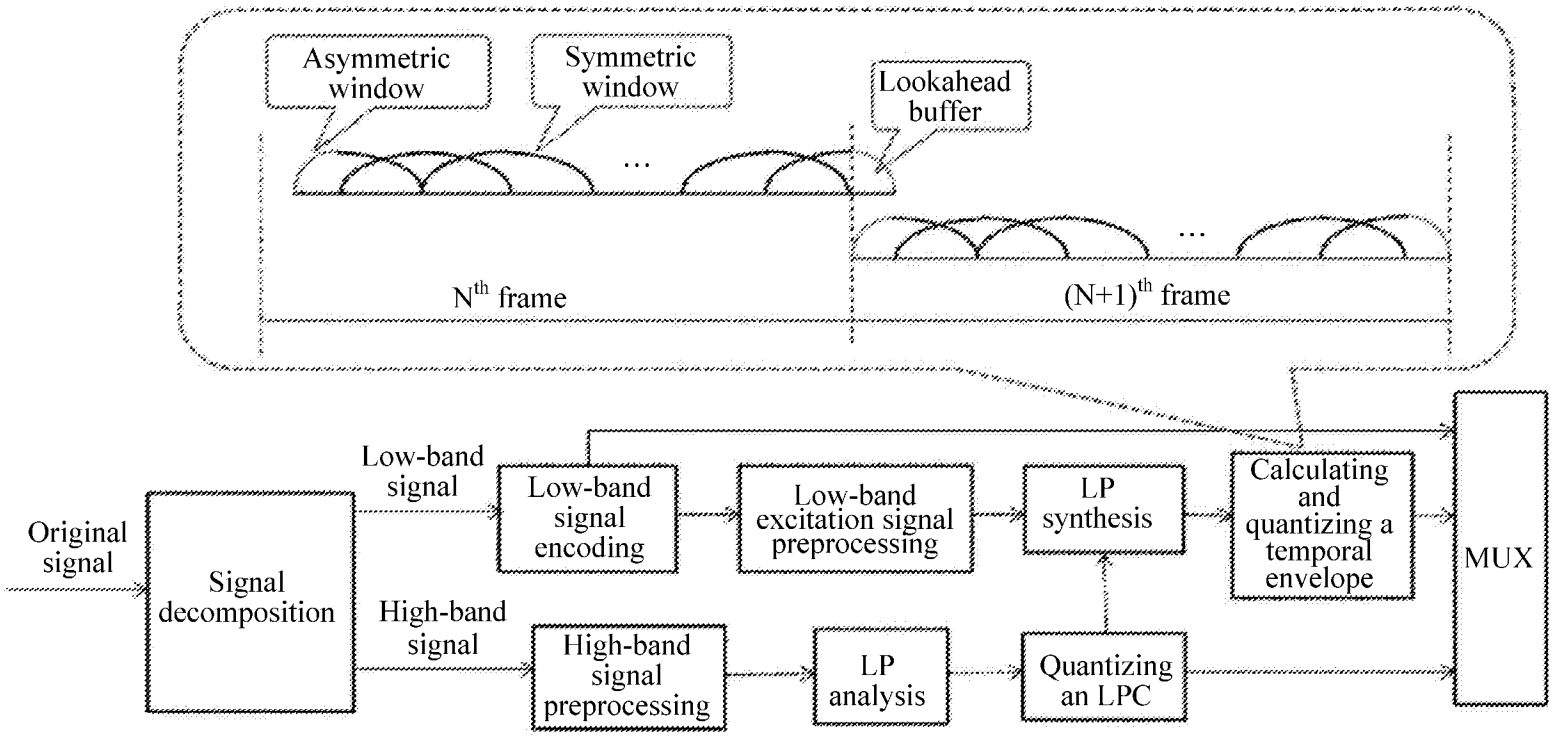
FIG. 5 is a schematic diagram showing processing on an audio signal according to another embodiment of the present invention.

The following describes in detail the step of calculating and quantizing the temporal envelope in another embodiment of the present invention by using processing on the $(N+1)^{th}$ frame shown in FIG. 5 as an example.

FIG. 5 is a schematic diagram showing processing on an audio signal according to another embodiment of the present invention. As shown in FIG. 5, on an encoding side, after an original audio signal is obtained, signal decomposition is first performed on the original audio signal, to obtain a low-band signal and a high-band signal of the original audio signal. Subsequently, the low-band signal is encoded by using an existing algorithm, to obtain a low-band stream. In addition, in a process of performing low-band encoding, a low-band excitation signal is obtained, and the low-band excitation signal is preprocessed. For the high-band signal of the original audio signal, preprocessing is first performed, then LP analysis is performed, to obtain an LP coefficient, and the LP coefficient is quantized. Subsequently, the preprocessed low-band excitation signal is processed by using an LP synthesis filter (a filter coefficient is the quantized LP coefficient), to obtain a predicted high-band signal. A temporal envelope of the high-band signal is calculated and quantized according to the preprocessed high-band signal and the predicted high-band signal, and finally, an encoded stream is output.

Except the step of calculating and quantizing the temporal envelope of the high-band signal, for processing of other steps of the audio signal, refer to a method used in the prior art, and details are not described herein.

The following describes in detail the step of calculating and quantizing the temporal envelope in this embodiment of the present invention by using processing on the $(N+1)^{th}$ frame shown in FIG. 5 as an example.

As shown in FIG. 5, the $(N+1)^{th}$ frame is divided into M subframes according to a quantity of temporal envelopes that need to be calculated, where M is a positive integer. In a possible implementation manner, a value of M may be 3, 4, 5, 8, or the like, which is not limited herein.

Windowing is performed on the first subframe of the M subframes and the last subframe of the M subframes by using an asymmetric window function. The first subframe of the M subframes of the $(N+1)^{th}$ frame is a subframe having an overlapped part with a signal of the previous frame (the $N^{th}$ frame); and the last subframe is a subframe having an overlapped part with a signal of a next frame (the $(N+2)^{th}$ frame, which is not shown in the figure). In a possible manner, as shown in FIG. 3, the first subframe is a leftmost subframe in the $(N+1)^{th}$ frame, and the last subframe is a rightmost subframe in the $(N+1)^{th}$ frame. It can be understood that leftmost and rightmost are merely specific examples with reference to FIG. 3, and are not limitations on this embodiment of the present invention. In practice, there is no directional limitation such as leftmost and rightmost in subframe division.

Asymmetric windows used to perform windowing on the first subframe and the last subframe may be completely the same or may be different, which is not limited herein. In a possible implementation manner, a window length of an asymmetric window function used for the first subframe is the same as a window length of an asymmetric window function used for the last subframe.

In a possible implementation manner of the present invention, windowing is performed on the first subframe of the M subframes and the last subframe of the M subframes by using an asymmetric window function. A shape of an asymmetric window function used for the first subframe of the M subframes is different from a shape of an asymmetric window function used for the last subframe of the M subframes. One asymmetric window function may overlap, after being rotated by 180 degrees in a horizontal direction, with the other asymmetric window function. In a possible implementation manner, a window length of an asymmetric window function used for the first subframe is the same as a window length of an asymmetric window function used for the last subframe. In an embodiment of the present invention, as shown in FIG. 5, windowing is performed on a subframe except the first subframe and the last subframe of the M subframes of the $(N+1)^{th}$ frame by using a symmetric window function. A window length of the symmetric window function is different from the window length of the asymmetric window function. For example, for a signal whose frame length is 20 ms (80 samples) and whose sampling rate is 4 kHz: if a lookahead buffer is 5 samples, 4 temporal envelopes are solved. The window function in this embodiment is used. Window lengths of two ends are 30 samples. When two continuous frames are aliased, a sample quantity is 5, and two middle window lengths are 50 samples, and 25 samples are aliased.

In an embodiment of the present invention, as shown in FIG. 5, windowing is performed on a subframe except the first subframe and the last subframe of the M subframes of the $(N+1)^{th}$ frame by using a symmetric window function.

In an embodiment of the present invention, a window length of the asymmetric window function used in windowing performed on the first subframe and the last subframe is equal to a window length of the symmetric window function used for another subframe. It can be understood that in another possible manner, the window length of the asymmetric window function may be not equal to the window length of the symmetric window function.

In an embodiment of the present invention, when a frame length of the $(N+1)^{th}$ frame is 80 samples and a sampling rate is 4 kHz, 8 temporal envelopes may be solved.

In a possible implementation manner, when the frame length of the $(N+1)^{th}$ frame is 80 samples and a sampling rate is 4 kHz, 4 temporal envelopes may be solved.

In an embodiment of the present invention, in addition to presetting, a quantity N of the temporal envelopes may be predetermined according to other information of the $(N+1)^{th}$ frame. The following is an example of an implementation manner of determining the quantity N of the temporal envelopes:

In a possible implementation manner, when a pitch period of a low-band signal of the $(N+1)^{th}$ frame is greater than a second threshold, 4 is assigned to N; or when a pitch period of a low-band signal of the $(N+1)^{th}$ frame is not greater than a second threshold, 8 is assigned to N. For a low-band signal whose sampling rate is 12.8 kHz, the second threshold may be 70 samples. It can be understood that the foregoing values are merely specific examples used to help understand this embodiment of the present invention, and are not specific limitations on this embodiment of the present invention. As shown in FIG. 3, when signal decomposition is performed on a signal of the $(N+1)^{th}$ frame, the low-band signal of the $(N+1)^{th}$ frame may be obtained. A method used in signal decomposition and a manner of solving the pitch period of the low-band signal may be any manner in the prior art, which is not specifically limited herein.

It can be understood that in addition to using the pitch period of the low-band signal, another parameter such as signal energy may be used.

In an embodiment of the present invention, when the asymmetric window function is used to perform windowing on the first subframe and the last subframe, the asymmetric window function is determined according to a lookahead buffer length.

In a possible implementation manner, when the frame length of the $(N+1)^{th}$ frame is 80 samples, the sampling rate is 4 kHz, and 8 temporal envelopes are solved, both the window length of the asymmetric window function used in windowing and the window length of the symmetric window function used in windowing may be 20 samples. A first threshold is obtained by dividing the frame length by a quantity of envelopes. In this example, the first threshold is equal to 10. When the lookahead buffer length is less than 10 samples, an aliased part of a window function used for the eighth subframe (this means, the last subframe) and a window function used for the first subframe (this means, the first subframe) is equal to the lookahead buffer length. When the lookahead buffer length is greater than or equal to 10 samples, a length of a right side of the window function used for the eighth subframe and a length of a left side of the window function used for the first subframe may be equal to a window length (10 samples) of the other side (for example, the right side of the window function used for the first subframe or the left side of the window function used for the eighth subframe); or a length may be set according to experience (for example, keeping a same length as that used when the lookahead buffer is less than 10 samples).

In a possible implementation manner, when the frame length of the $(N+1)^{th}$ frame is 80 samples, the sampling rate is 4 kHz, and 4 temporal envelopes are solved, both the window length of the asymmetric window function used in windowing and the window length of the symmetric window function used in windowing may be 40 samples. The first threshold is obtained by dividing the frame length by a quantity of envelopes. In this example, the first threshold is equal to 20.

After windowing, an average value of time-domain energy of the subframes of the preprocessed original high-band signal, or an average value of sample amplitudes in the subframes of the preprocessed original high-band signal; and an average value of time-domain energy of the subframes of the predicted high-band signal, or an average value of sample amplitudes in the subframes of the predicted high-band signal are calculated. For a specific calculation manner, refer to a manner provided in the prior art. Manners of determining a window shape and a needed window quantity that are used in windowing in the method for processing a signal provided in this embodiment of the present invention are different from those in the prior art. For another calculation manner, refer to a manner provided in the prior art.

According to the method for processing a temporal envelope of an audio signal provided in this embodiment of the present invention, a temporal envelope is solved by using different window lengths and/or window shapes under different conditions, so as to reduce impact of energy discontinuity caused due to an excessively large difference between temporal envelopes, thereby improving performance of an output signal.

According to the method for processing a temporal envelope of an audio signal provided in this embodiment, a high-band signal of an audio frame is obtained according to a received audio frame signal, then the high-band signal of the audio frame is divided into M subframes according to a predetermined temporal envelope quantity M, and finally, a temporal envelope of each of the subframes is calculated, thereby effectively avoiding a problem of solving excessive temporal envelopes that is caused when a lookahead is extremely short and extremely good inter-subframe aliasing needs to be ensured, further avoiding a problem of energy discontinuity that is caused by excessively solving temporal envelopes for some signals, and also reducing calculation complexity.

Figure 6:
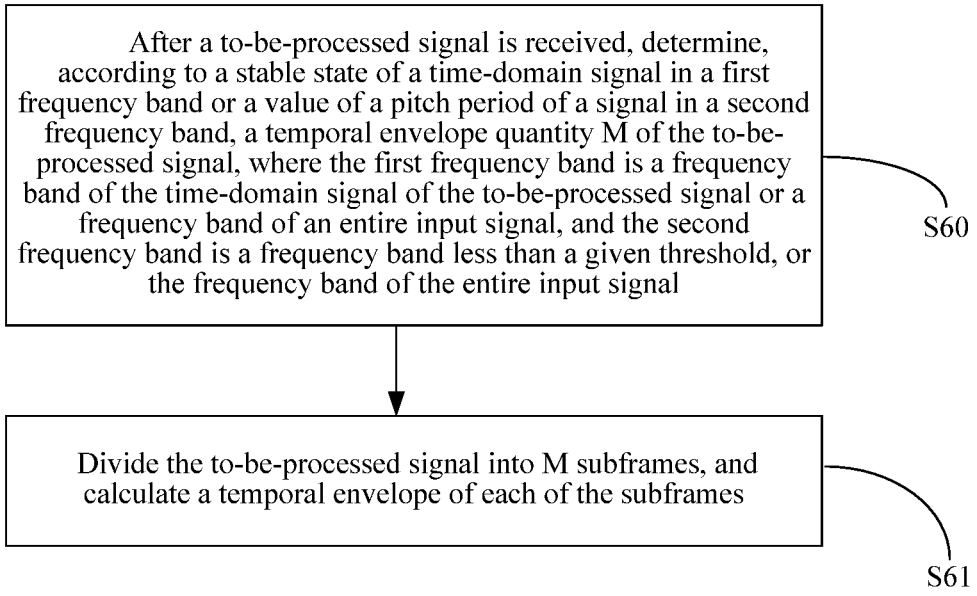
FIG. 6 is a flowchart of Embodiment 2 of a method for processing a temporal envelope of an audio signal according to the present invention.

FIG. 6 is a flowchart of Embodiment 2 of a method for processing a temporal envelope of an audio signal according to the present invention. As shown in FIG. 6, the method in this embodiment may include the following steps.

S60. After a to-be-processed signal is received, determine, according to a stable state of a time-domain signal in a first frequency band or a value of a pitch period of a signal in a second frequency band, a temporal envelope quantity M of the to-be-processed signal, where the first frequency band is a frequency band of the time-domain signal of the to-be-processed signal or a frequency band of an entire input signal, and the second frequency band is a frequency band less than a given threshold, or the frequency band of the entire input signal.

The determining a temporal envelope quantity M of the to-be-processed signal includes:

when the time-domain signal in the first frequency band is in the stable state or the pitch period of the signal in the second frequency band is greater than a preset threshold, M is equal to M1; otherwise, M is equal to M2, where M1 is greater than M2, both M1 and M2 are positive integers, and the preset threshold is determined according to a sampling rate.

The stable state refers to that an average value of energy and amplitudes of the time-domain signal in a period of time does not change much, or a deviation of the time-domain signal in a period of time is less than a given threshold.

For example, for a high-band signal whose frame length is 20 ms (80 samples) and whose sampling rate is 4 kHz, if a ratio of inter-subframe energy of a high-band time-domain signal is less than a given threshold (less than 0.5), or a pitch period of a low-band signal is greater than a given threshold (greater than 70 samples, in which case, a sampling rate of the low-band signal is 12.8 kHz), when a temporal envelope is solved for the high-band signal, 4 temporal envelopes are solved; otherwise, 8 temporal envelopes are solved.

For example, for a high-band signal whose frame length is 20 ms (320 samples) and whose sampling rate is 16 kHz, if a ratio of inter-subframe energy of a high-band time-domain signal is less than the given threshold (less than 0.5), or the pitch period of the low-band signal is greater than the given threshold (greater than 70 samples, in which case, a sampling rate of the low-band signal is 12.8 kHz), when a temporal envelope is solved for the high-band signal, 2 temporal envelopes are solved; otherwise, 4 temporal envelopes are solved.

S61. Divide the to-be-processed signal into M subframes, and calculate a temporal envelope of each of the subframes.

In this embodiment, when windowing is performed on each of the subframes, a manner in which windowing is performed is not limited.

According to the method for processing a temporal envelope of an audio signal provided in this embodiment, different quantities of temporal envelopes are solved according to different conditions, thereby effectively avoiding energy discontinuity caused when excessive temporal envelopes are solved for a signal under a condition, further avoiding an auditory quality decrease caused by the energy discontinuity, and in addition, effectively reducing average complexity of an algorithm.

An embodiment of the present invention further provides an apparatus for processing a temporal envelope of an audio signal, which may be configured to execute some methods shown in FIG. 1 to FIG. 5, and may be further used for another processing process of solving a temporal envelope by using a same principle. The following describes in detail a structure of the apparatus for processing a temporal envelope of an audio signal provided in this embodiment of the present invention with reference to an accompanying drawing.

Figure 7:
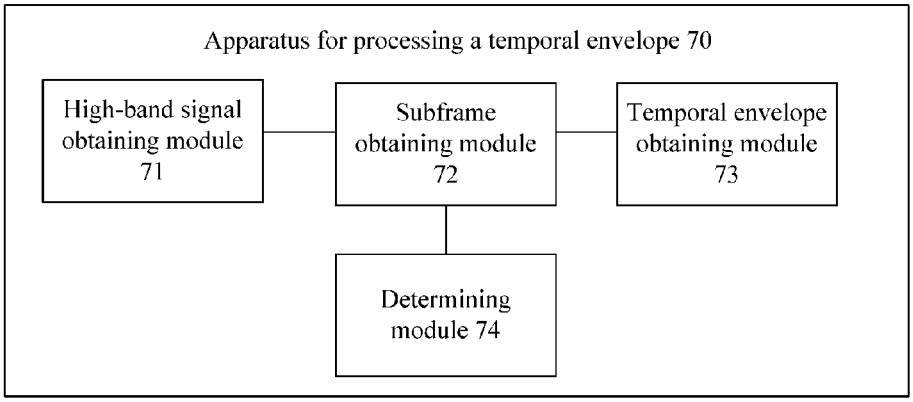
FIG. 7 is a schematic structural diagram of an apparatus for processing a temporal envelope according to an embodiment of the present invention.

FIG. 7 is a schematic structural diagram of an apparatus for processing a temporal envelope according to an embodiment of the present invention. As shown in FIG. 7, the apparatus 70 for processing a temporal envelope in this embodiment includes: a high-band signal obtaining module 71, configured to obtain a high-band signal of the current frame signal according to the received current frame signal; a subframe obtaining module 72, configured to divide the high-band signal of the current frame into M subframes according to a predetermined temporal envelope quantity M, where M is an integer, M is greater than or equal to 2; and a temporal envelope obtaining module 73, configured to calculate a temporal envelope of each of the subframes, where the temporal envelope obtaining module 73 is configured to: perform windowing on the first subframe of the M subframes and the last subframe of the M subframes by using an asymmetric window function; and perform windowing on a subframe except the first subframe and the last subframe of the M subframes.

In a possible manner of this embodiment of the present invention, the temporal envelope obtaining module 73 is further configured to:

determine the asymmetric window function according to a lookahead buffer length of the high-band signal of the current frame signal; or determine the asymmetric window function according to a lookahead buffer length of the high-band signal of the current frame signal and the temporal envelope quantity M.

In an embodiment of the present invention, the temporal envelope obtaining module 73 is configured to:

perform windowing on the first subframe of the M subframes and the last subframe of the M subframes by using the asymmetric window function, and perform windowing on the subframe except the first subframe and the last subframe of the M subframes by using a symmetric window function; or perform windowing on the first subframe of the M subframes and the last subframe of the M subframes by using the asymmetric window function, and perform windowing on the subframe except the first subframe and the last subframe of the M subframes by using an asymmetric window function.

In a possible implementation manner of this embodiment of the present invention, a window length of the asymmetric window function is the same as a window length of a window function used in windowing performed on the subframe except the first subframe and the last subframe of the M subframes. In an embodiment of the present invention, the temporal envelope obtaining module 73 is further configured to: obtain a pitch period of a low-band signal of the current frame signal according to the current frame signal; and when a type of the current frame signal is the same as a type of a previous frame signal of the current frame and the pitch period of the low-band signal of the current frame is greater than a third threshold, perform smoothing processing on the temporal envelope of each of the subframes.

The performing smoothing processing on the temporal envelope may be: weighting temporal envelopes of two adjacent subframes, and using the weighted temporal envelopes as temporal envelopes of the two subframes. For example, when signals of two continuous frames on a decoding side are voiced signals, or one frame is a voiced signal and the other frame is a normal signal, and the pitch period of the low-band signal is greater than a given threshold (greater than 70 samples, in which case, a sampling rate of the low-band signal is 12.8 kHz), smoothing processing is performed on a temporal envelope of a decoded high-band signal; otherwise, the temporal envelope remains unchanged. The smoothing processing may be as follows:

$$env[0] = 0.5 * (env[0] + env[1]);$$

$$env[1] = 0.5 * (env[0] + env[1]);$$

$$\ldots$$

$$env[N-1] = 0.5 * (env[N-1] + env[N]); \text{ and}$$

$$env[N] = 0.5 * (env[N-1] + env[N]); \text{ where}$$

$$env[\,] \text{ is a temporal envelope.}$$

In an embodiment of the present invention, the apparatus 70 for processing a temporal envelope further includes: a determining module 74, configured to determine the temporal envelope quantity M in one of the following manners:

obtaining the low-band signal of the current frame signal according to the current frame signal, and when a pitch period of the low-band signal of the current frame signal is greater than a second threshold, assigning M1 to M; or obtaining the low-band signal of the current frame signal according to the current frame signal, and when a pitch period of the low-band signal of the current frame signal is not greater than a second threshold, assigning M2 to M, where both M1 and M2 are positive integers, and M2>M1.

In this embodiment of the present invention, the predetermined temporal envelope quantity M may be determined according to a requirement of an overall algorithm and an empirical value. The temporal envelope quantity M is, for example, predetermined by an encoder according to the overall algorithm or the empirical value, and does not change after being determined. For example, generally, for an input signal with a frame of 20 ms, if the input signal is relatively stable, four or two temporal envelopes are solved, but for some unstable signals, more temporal envelopes, for example, eight temporal envelopes, need to be solved.

First, on an encoding side, after an original audio signal is obtained, signal decomposition is first performed on the original audio signal, to obtain a low-band signal and a high-band signal of the original audio signal. Subsequently, the low-band signal is encoded by using an existing algorithm, to obtain a low-band stream. In addition, in a process of performing low-band encoding, a low-band excitation signal is obtained, and the low-band excitation signal is preprocessed. For the high-band signal of the original audio signal, preprocessing is first performed, then LP analysis is performed, to obtain an LP coefficient, and the LP coefficient is quantized. Subsequently, the preprocessed low-band excitation signal is processed by using an LP synthesis filter (a filter coefficient is the quantized LP coefficient), to obtain a predicted high-band signal. A temporal envelope of the high-band signal is calculated and quantized according to the preprocessed high-band signal and the predicted high-band signal, and finally, an encoded stream is output.

Except the step of calculating and quantizing the temporal envelope of the high-band signal, for processing of other steps of the audio signal, refer to a method used in the prior art, and details are not described herein.

The apparatus in this embodiment can be configured to execute technical solutions of method embodiments shown in FIG. 2 to FIG. 5. Implementation principles thereof are similar.

In an example, on an encoding side, after an original audio signal is obtained, signal decomposition is first performed on the original audio signal, to obtain a low-band signal and a high-band signal of the original audio signal. Subsequently, the low-band signal is encoded by using an existing algorithm, to obtain a low-band stream. In addition, in a process of performing low-band encoding, a low-band excitation signal is obtained, and the low-band excitation signal is preprocessed. For the high-band signal of the original audio signal, preprocessing is first performed, then LP analysis is performed, to obtain an LP coefficient, and the LP coefficient is quantized. Subsequently, the preprocessed low-band excitation signal is processed by using an LP synthesis filter (a filter coefficient is the quantized LP coefficient), to obtain a predicted high-band signal. A temporal envelope of the high-band signal is calculated and quantized according to the preprocessed high-band signal and the predicted high-band signal, and finally, an encoded stream is output.

Except the step of calculating and quantizing the temporal envelope of the high-band signal, for processing of other steps of the audio signal, refer to a method used in the prior art, and details are not described herein.

The $(N+1)^{th}$ frame is divided into M subframes according to a quantity of temporal envelopes that need to be calculated, where M is a positive integer. In a possible implementation manner, a value of M may be 3, 4, 5, 8, or the like, which is not limited herein.

Windowing is performed on the first subframe of the M subframes and the last subframe of the M subframes by using an asymmetric window function. The first subframe of the M subframes of the $(N+1)^{th}$ frame is a subframe having an overlapped part with a signal of the previous frame (the $N^{th}$ frame); and the last subframe is a subframe having an overlapped part with a signal of a next frame (the $(N+2)^{th}$ frame, which is not shown in the figure). In a possible manner, the first subframe is a leftmost subframe in the $(N+1)^{th}$ frame, and the last subframe is a rightmost subframe in the $(N+1)^{th}$ frame. It can be understood that leftmost and rightmost are merely specific examples, and are not limitations on this embodiment of the present invention. In practice, there is no directional limitation such as leftmost and rightmost in subframe division.

Asymmetric windows used to perform windowing on the first subframe and the last subframe may be completely the same or may be different, which is not limited herein. In a possible implementation manner, a window length of an asymmetric window function used for the first subframe is the same as a window length of an asymmetric window function used for the last subframe.

In an embodiment of the present invention, windowing is performed on a subframe except the first subframe and the last subframe of the M subframes of the $(N+1)^{th}$ frame by using a symmetric window function.

In an embodiment of the present invention, a window length of the asymmetric window function used in windowing performed on the first subframe and the last subframe is equal to a window length of the symmetric window function used for another subframe. It can be understood that in another possible manner, the window length of the asymmetric window function may be not equal to the window length of the symmetric window function.

In an embodiment of the present invention, when a frame length of the (N+1)th frame is 80 samples and a sampling rate is 4 kHz, 8 temporal envelopes may be solved.

In a possible implementation manner, when the frame length of the (N+1)th frame is 80 samples and a sampling rate is 4 kHz, 4 temporal envelopes may be solved.

In an embodiment of the present invention, in addition to presetting, a quantity N of the temporal envelopes may be predetermined according to other information of the $(N+1)^{th}$ frame. The following is an example of an implementation manner of determining the quantity N of the temporal envelopes:

In a possible implementation manner, when a pitch period of a low-band signal of the (N+1)th frame is greater than a second threshold, N=4; or when a pitch period of a low-band signal of the (N+1)th frame is not greater than a second threshold, N=8. For a low-band signal whose sampling rate is 12.8 kHz, the second threshold may be 70 samples. It can be understood that the foregoing values are merely specific examples used to help understand this embodiment of the present invention, and are not specific limitations on this embodiment of the present invention. When signal decomposition is performed on a signal of the (N+1)th frame, the low-band signal of the (N+1)th frame may be obtained. A method used in signal decomposition and a manner of solving the pitch period of the low-band signal may be any manner in the prior art, which is not specifically limited herein.

It can be understood that in addition to using the pitch period of the low-band signal, another parameter such as signal energy may be used.

In an embodiment of the present invention, when the asymmetric window function is used to perform windowing on the first subframe and the last subframe, the asymmetric window function is determined according to a lookahead buffer length.

In a possible implementation manner, when the frame length of the (N+1)th frame is 80 samples, the sampling rate is 4 kHz, and 8 temporal envelopes are solved, both the window length of the asymmetric window function used in windowing and the window length of the symmetric window function used in windowing may be 20 samples. A first threshold is obtained by dividing the frame length by a quantity of envelopes. In this example, the first threshold is equal to 10. When the lookahead buffer length is less than 10 samples, an aliased part of a window function used for the eighth subframe (this means, the last subframe) and a window function used for the first subframe (this means, the first subframe) is equal to the lookahead buffer length. When the lookahead buffer length is greater than or equal to 10 samples, a length of a right side of the window function used for the eighth subframe and a length of a left side of the window function used for the first subframe may be equal to a window length (10 samples) of the other side (for example, the right side of the window function used for the first subframe or the left side of the window function used for the eighth subframe); or a length may be set according to experience (for example, keeping a same length as that used when the lookahead buffer is less than 10 samples).

In a possible implementation manner, when the frame length of the (N+1)th frame is 80 samples, the sampling rate is 4 kHz, and 4 temporal envelopes are solved, both the window length of the asymmetric window function used in windowing and the window length of the symmetric window function used in windowing may be 40 samples. The first threshold is obtained by dividing the frame length by a quantity of envelopes. In this example, the first threshold is equal to 20.

After windowing, an average value of time-domain energy of the subframes of the preprocessed original high-band signal, or an average value of sample amplitudes in the subframes of the preprocessed original high-band signal; and an average value of time-domain energy of the subframes of the predicted high-band signal, or an average value of sample amplitudes in the subframes of the predicted high-band signal are calculated. For a specific calculation manner, refer to a manner provided in the prior art. Manners of determining a window shape and a needed window quantity that are used in windowing in the method for processing a signal provided in this embodiment of the present invention are different from those in the prior art. For another calculation manner, refer to a manner provided in the prior art.

According to the apparatus for processing a temporal envelope of an audio signal provided in this embodiment, different quantities of temporal envelopes are solved according to different conditions, thereby effectively avoiding energy discontinuity caused when excessive temporal envelopes are solved for a signal under a condition, further avoiding an auditory quality decrease caused by the energy discontinuity, and in addition, effectively reducing average complexity of an algorithm.

Figure 8:
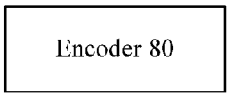
FIG. 8 is a schematic structural diagram of an encoder according to an embodiment of the present invention.

The following describes an encoder 80 in an embodiment of the present invention with reference to FIG. 8. FIG. 8 is a schematic structural diagram of the encoder according to an embodiment of the present invention. As shown in FIG. 8, the encoder 80 is configured to:

obtain a low-band signal of the current frame signal and a high-band signal of the current frame signal according to the received current frame signal;

encode the low-band signal of the current frame signal, to obtain a low-band encoded excitation signal;

perform linear prediction on the high-band signal of the current frame signal, to obtain a linear prediction coefficient;

quantize the linear prediction coefficient, to obtain a quantized linear prediction coefficient;

obtain a predicted high-band signal according to the low-band encoded excitation signal and the quantized linear prediction coefficient;

calculate and quantize a temporal envelope of the predicted high-band signal, where the calculating a temporal envelope of the predicted high-band signal includes:

dividing the predicted high-band signal into M subframes according to a predetermined temporal envelope quantity M, where M is an integer, M is greater than or equal to 2;

performing windowing on the first subframe of the M subframes and the last subframe of the M subframes by using an asymmetric window function; and performing windowing on a subframe except the first subframe and the last subframe of the M subframes; and encode the quantized temporal envelope.

It can be understood that the encoder 80 may be configured to execute any one of the foregoing method embodiments, and may include the apparatus 70 for processing a temporal envelope in any embodiment. For a specific function executed by the encoder 80, refer to the foregoing method and apparatus embodiments, and details are not described herein.

Persons of ordinary skill in the art may understand that all or a part of the steps of the method embodiments may be implemented by a program instructing relevant hardware. The program may be stored in a computer readable storage medium. When the program runs, the steps of the method embodiments are performed. The foregoing storage medium includes: any medium that can store program code, such as a ROM, a RAM, a magnetic disc, or an optical disc.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A method for encoding an audio signal, comprising:

obtaining an audio signal;

obtaining a high-band signal of a current frame of the audio signal;

dividing the high-band signal of the current frame of the audio signal into M subframes, werein M is an integer, and M is greater than or equal to 2; and calculating a temporal envelope of each of the M subframes, wherein the temporal envelope of each of the M subframes is obtained by performing windowing on a first subframe of the M subframes and a last subframe of the M subframes by using a first asymmetric window function; and performing windowing on a subframe except the first subframe and the last subframe of the M subframes;

encoding the current frame of the audio signal according to the temporal envelope of each of the M subframes.

2. The method according to claim 1, wherein before the performing windowing on the first subframe of the M subframes and the last subframe of the M subframes by using the first asymmetric window function, the method further comprises:

determining the first asymmetric window function according to a lookahead buffer length of the high-band signal of the current frame of the audio signal; or determining the first asymmetric window function according to a lookahead buffer length of the high-band signal of the current frame of the audio signal and the M.

3. The method according to claim 1, wherein the performing windowing on the subframe except the first subframe and the last subframe of the M subframes comprises:

performing windowing on the subframe except the first subframe and the last subframe of the M subframes by using a symmetric window function; or performing windowing on the subframe except the first subframe and the last subframe of the M subframes by using a second asymmetric window function.

4. The method according to claim 1, wherein a window length of the asymmetric window function is same as a window length of a window function used in windowing performed on the subframe except the first subframe and the last subframe of the M subframes.

5. The method according to claim 2, wherein the determining the first asymmetric window function according to the lookahead buffer length of the high-band signal of the current frame of the audio signal comprises:

when the lookahead buffer length of the high-band signal of the current frame of the audio signal is less than a first threshold, determining the first asymmetric window function according to a high-band signal of a previous frame signal of the current frame and the lookahead buffer length of the high-band signal of the current frame of the audio signal, wherein an aliased part of an asymmetric window function used for a last subframe of the high-band signal of the previous frame signal of the current frame and an asymmetric window function used for the first subframe of the high-band signal of the current frame of the audio signal is equal to the lookahead buffer length of the high-band signal of the current frame of the audio signal, and the first threshold is equal to a frame length of the high-band signal of the current frame divided by M.

6. The method according to claim 2, wherein the determining the first asymmetric window function according to the lookahead buffer length of the high-band signal of the current frame of the audio signal comprises:

when the lookahead buffer length of the high-band signal of the current frame of the audio signal is greater than a first threshold, determining the first asymmetric window function according to a high-band signal of a previous frame of the audio signal of the current frame and the lookahead buffer length of the high-band signal of the current frame of the audio signal, wherein an aliased part of an asymmetric window function used for a last subframe of the high-band signal of the previous frame of the audio signal of the current frame and an asymmetric window function used for the first subframe of the high-band signal of the current frame of the audio signal is equal to the first threshold, and the first threshold is equal to a frame length of the high-band signal of the current frame divided by M.

7. The method according to claim 1, wherein the M is determined in one of the following manners:

obtaining a low-band signal of the current frame of the audio signal according to the current frame of the audio signal, and when a pitch period of the low-band signal of the current frame of the audio signal is greater than a second threshold, assigning M1 to M; or obtaining a low-band signal of the current frame of the audio signal according to the current frame of the audio signal, and when a pitch period of the low-band signal of the current frame of the audio signal is not greater than a second threshold, assigning M2 to M, wherein both M1 and M2 are positive integers, and M2>M1.

8. The method according to claim 1, wherein the method further comprises:

obtaining a pitch period of a low-band signal of the current frame of the audio signal according to the current frame of the audio signal; and when a type of the current frame of the audio signal is same as a type of a previous frame signal of the current frame and the pitch period of the low-band signal of the current frame is greater than a third threshold, performing smoothing processing on the temporal envelope of each of the M subframes.

9. An apparatus for encoding an audio signal, comprising:

a memory comprising instructions; and a processor in communication with the memory, wherein the processor executes the instructions to:

obtain an audio signal;

obtain a high-band signal of a current frame of the audio signal;

divide the high-band signal of the current frame of the audio signal into M subframes, wherein M is an integer, and M is greater than or equal to 2;

calculate a temporal envelope of each of the M subframes, wherein the temporal envelope of each of the M subframes is obtained by perform windowing on a first subframe of the M subframes and a last subframe of the M subframes by using a first asymmetric window function, perform windowing on a subframe except the first subframe and the last subframe of the M subframes; and encoding the current frame of the audio signal according to the temporal envelope of each of the M subframes.

10. The apparatus according to claim 9, wherein the processor further executes the instructions to:

determine the first asymmetric window function according to a lookahead buffer length of the high-band signal of the current frame of the audio signal; or determine first the asymmetric window function according to a lookahead buffer length of the high-band signal of the current frame of the audio signal and the M.

11. The apparatus according to claim 9, wherein the processor further executes the instructions to:

perform windowing on the first subframe of the M subframes and the last subframe of the M subframes by using the first asymmetric window function, and perform windowing on the subframe except the first subframe and the last subframe of the M subframes by using a symmetric window function; or perform windowing on the first subframe of the M subframes and the last subframe of the M subframes by using the first asymmetric window function, and perform windowing on the subframe except the first subframe and the last subframe of the M subframes by using a second asymmetric window function.

12. The apparatus according to claim 9, wherein a window length of the first asymmetric window function is same as a window length of a window function used in windowing performed on the subframe except the first subframe and the last subframe of the M subframes.

13. The apparatus according to claim 9, wherein the processor further executes the instructions to:

determine the M in one of the following manners:

obtain a low-band signal of the current frame of the audio signal according to the current frame of the audio signal, and when a pitch period of the low-band signal of the current frame of the audio signal is greater than a second threshold, assigning M1 to M; or obtain a low-band signal of the current frame of the audio signal according to the current frame of the audio signal, and when a pitch period of the low-band signal of the current frame of the audio signal is not greater than a second threshold, assigning M2 to M, wherein both M1 and M2 are positive integers, and M2>M1.

14. The apparatus according to claim 9, wherein the processor executes the instructions to:

obtain a pitch period of a low-band signal of the current frame of the audio signal according to the current frame of the audio signal; and when a type of the current frame of the audio signal is same as a type of a previous frame signal of the current frame and the pitch period of the low-band signal of the current frame is greater than a third threshold, perform smoothing processing on the temporal envelope of each of the M subframes.

15. An encoder, wherein the encoder comprise:

a memory comprising instructions; and a processor coupled to the memory, wherein the processor executes the instructions to:

obtain an audio signal;

obtain a low-band signal of a current frame of the audio signal and a high-band signal of the current frame of the audio signal according to the current frame of the audio signal;

encode the low-band signal of the current frame of the audio signal to obtain a low-band encoded excitation signal;

perform linear prediction on the high-band signal of the current frame of the audio signal to obtain a linear prediction coefficient;

quantize the linear prediction coefficient to obtain a quantized linear prediction coefficient;

obtain a predicted high-band signal according to the low-band encoded excitation signal and the quantized linear prediction coefficient;

calculate and quantize a temporal envelope of the predicted high-band signal, wherein the temporal envelope of the predicted high-band signal is calculated by:

dividing the predicted high-band signal into M subframes, wherein M is an integer, M is greater than or equal to 2;

performing windowing on a first subframe of the M subframes and a last subframe of the M subframes by using an asymmetric window function; and performing windowing on a subframe except the first subframe and the last subframe of the M subframes; and encode the quantized temporal envelope.

* * * * *